US009872531B2

(12) United States Patent
Uke et al.

(10) Patent No.: US 9,872,531 B2
(45) Date of Patent: Jan. 23, 2018

(54) HELMET ASSEMBLY

(71) Applicants: Alan Uke, Del Mar, CA (US); Andrew Zoolakis, Carlsbad, CA (US); Dan Wert, San Diego, CA (US)

(72) Inventors: Alan Uke, Del Mar, CA (US); Andrew Zoolakis, Carlsbad, CA (US); Dan Wert, San Diego, CA (US)

( * ) Notice: Subject to any disclaimer, the term of this patent is extended or adjusted under 35 U.S.C. 154(b) by 38 days.

(21) Appl. No.: 14/868,066

(22) Filed: Sep. 28, 2015

(65) Prior Publication Data

US 2017/0089554 A1 Mar. 30, 2017

(51) Int. Cl.

| | |
|---|---|
| ***A47B 96/06*** | (2006.01) |
| ***A42B 3/04*** | (2006.01) |
| *A45F 5/02* | (2006.01) |

(52) U.S. Cl.

CPC . *A42B 3/04* (2013.01); *A45F 5/02* (2013.01)

(58) Field of Classification Search

CPC .... F21V 21/088; F21V 17/12; F21V 21/0808; F21V 21/30; F21V 21/084; A45F 5/02; A42B 3/0406; A42B 3/0433; A42B 3/044; A42B 3/0446

USPC ..... 248/222.11, 220.21, 221.11, 187.1; 362/396, 105

See application file for complete search history.

(56) References Cited

U.S. PATENT DOCUMENTS

| | | | | |
|---|---|---|---|---|
| 5,026,016 | A * | 6/1991 | Lisowski | F16B 21/09 248/225.11 |
| 5,605,501 | A * | 2/1997 | Wiand | B24B 13/01 451/526 |
| 5,620,120 | A * | 4/1997 | Tien | A45F 5/02 224/194 |
| 6,457,838 | B1 * | 10/2002 | Dugmore | F21L 15/14 362/105 |
| 6,497,493 | B1 * | 12/2002 | Theisen | A42B 3/044 2/422 |
| 8,517,559 | B1 * | 8/2013 | Freschl | F21L 13/06 362/105 |
| 9,380,868 | B1 * | 7/2016 | Fu | A47B 57/34 |
| 9,468,294 | B2 * | 10/2016 | Fu | A47B 96/024 |
| 2004/0061032 | A1 * | 4/2004 | Bradford | F21V 21/116 248/218.4 |
| 2009/0059063 | A1 * | 3/2009 | Gallagher | A42B 3/042 348/373 |
| 2011/0024585 | A1 * | 2/2011 | Brinkdopke | F16B 45/02 248/205.4 |
| 2011/0142436 | A1 * | 6/2011 | Eynav | A45F 5/02 396/420 |
| 2012/0057331 | A1 * | 3/2012 | Janice | F21L 4/02 362/105 |

* cited by examiner

*Primary Examiner* — Christopher E Garft
(74) *Attorney, Agent, or Firm* — David M. Breiner; BrownWinick Law Firm

(57) ABSTRACT

Disclosed is an assembly which may attach to a helmet. In at least one example embodiment, the assembly may include a light, a clip, and a bracket. In the instant example the light may include at least one engaging member configured to engage at least one engaging member on the clip and the clip may be configured to attach to the bracket with at least one fastener.

12 Claims, 12 Drawing Sheets

HELMET ASSEMBLY

BACKGROUND

1. Field

Example embodiments relate to an assembly. In at least one example embodiment, the assembly may include a light and the assembly may attach the light to a helmet.

2. Description of the Prior Art

Helmets are worn by workers and athletes alike. Climbers, for example, wear helmets to protect their head from falling rocks. Bikers wear helmets to protect their heads in case of an accident. Construction workers and minors wear helmets to protect their heads from debris. In some situations, workers and athletes wear helmets in relatively dark places. To compensate for the darkness many users attach lights to the helmets. The attaching means, however, are sometimes difficult to use and/or do not properly secure the light to the helmet.

SUMMARY

Example embodiments relate to an assembly. In at least one example embodiment the assembly may include a light and the assembly may attach the light to a helmet.

In accordance with example embodiments, an assembly may include a light, a clip, and a bracket. In example embodiments the light may include at least one engaging member configured to engage at least one engaging member on the clip and the clip may be configured to attach to the bracket with at least one fastener.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1A:
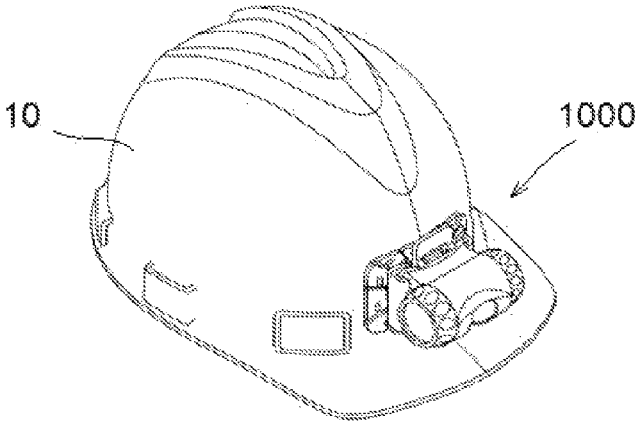
FIG. 1A is a view of a helmet with an assembly thereon in accordance with example embodiments.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to an assembly. In at least one example embodiment, the assembly may include a light and the assembly may attach the light to a helmet.

Figure 1B:
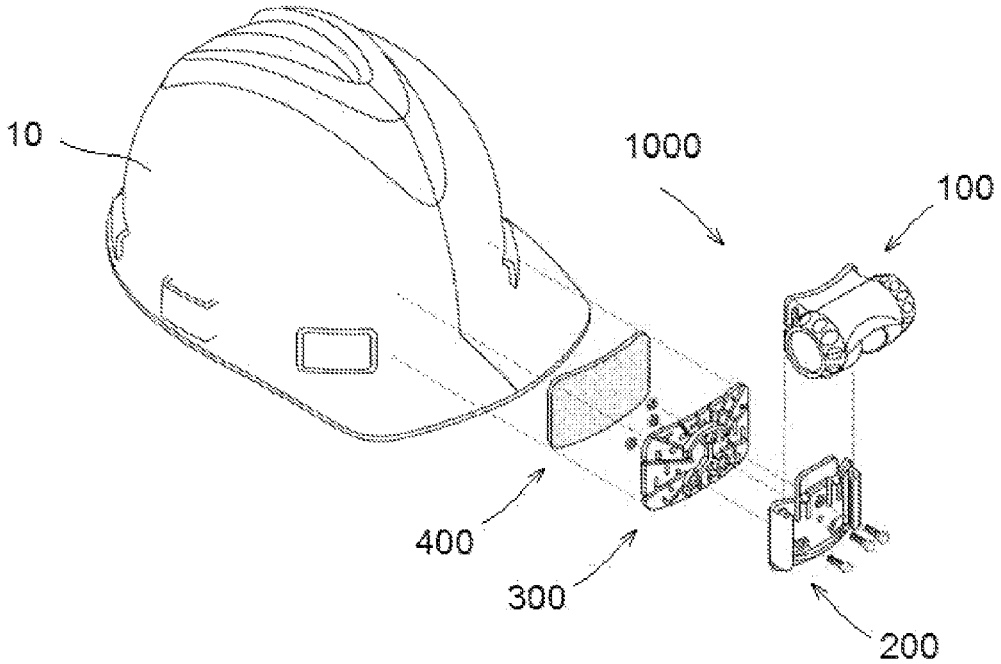
FIG. 1B is a view of the helmet with the assembly shown as exploded.

FIG. 1A is a view of a helmet 10 with an assembly 1000 mounted thereon. FIG. 1B illustrates an exploded view of the assembly 1000 in relation to the helmet 10. As shown in FIG. 1B, the assembly 1000 may include a light 100 (an example of an electrical device), a clip 200, a bracket 300, and an adhesive member 400. In example embodiments, the light 100 may be removably connected to the clip 200 and the clip 200 may be, but is not required to be, removably attached to the bracket 300. In example embodiments, the adhesive member 400 may attach the bracket 300 to the helmet 10. In one example embodiment, the adhesive member 400 may be a double sided tape, however, example embodiments are not limited thereto. For example, the adhesive member 400 may simply be an adhesive applied to the bracket 300 to attach the bracket 300 to the helmet 10. On the other hand, other attachment means, for example, screws and or clips, may be used to attach the bracket 300 to the helmet 10. Thus, in at least one example embodiment, the assembly 1000 does not include the adhesive member 400.

Figure 2A:
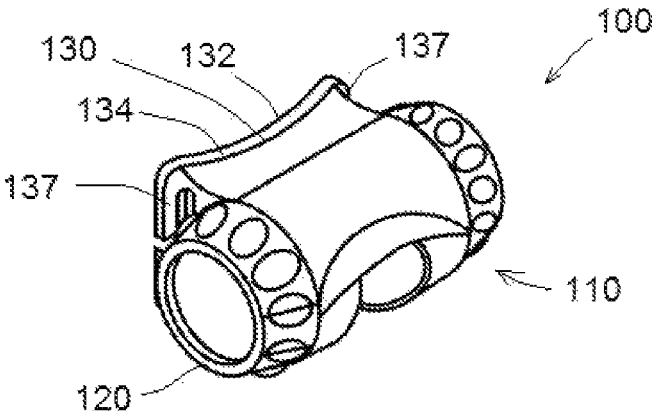
FIG. 2A is a first perspective view of a light in accordance with example embodiments.
Figure 2B:
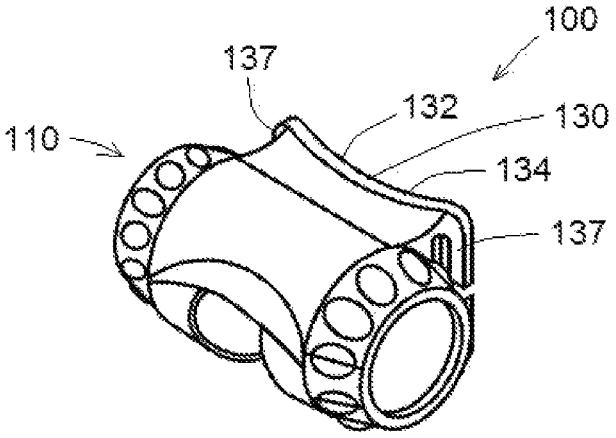
FIG. 2B is a second perspective view of the light in accordance with example embodiments.
Figure 2C:
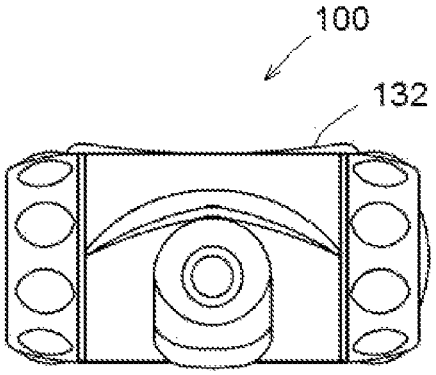
FIG. 2C is a top view of the light in accordance with example embodiments.
Figure 2D:
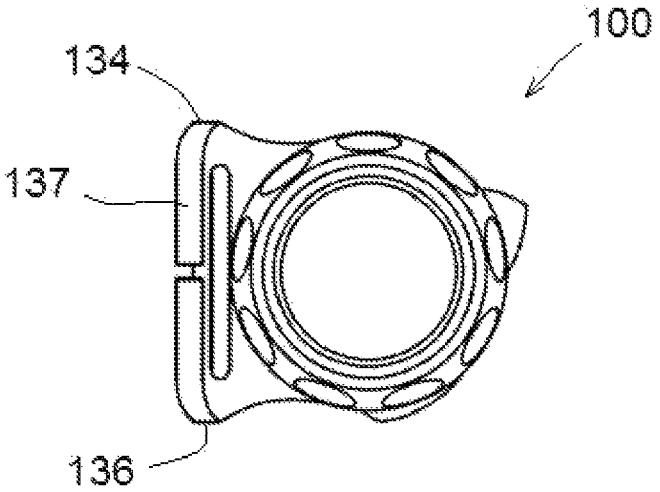
FIG. 2D is a first side view of the light in accordance with example embodiments.
Figure 2E:
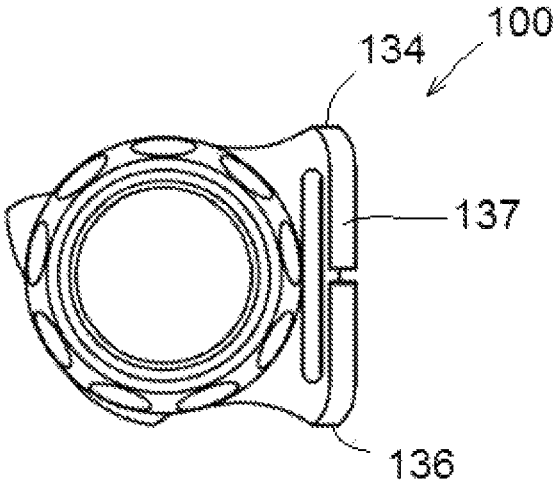
FIG. 2E is a second side view of the light in accordance with example embodiments.

FIGS. 2A-2E illustrate various views of the light 100 in accordance with example embodiments. FIG. 2A, for example, illustrates a first perspective view of the light 100 as viewed from a left side of the light 100, FIG. 2B illustrates a second perspective view of the light as viewed from a right side of the light 100, FIG. 2C illustrates a top view of the light 100, FIG. 2D illustrates view of the light 100 as if an observer were on a left side of the light 100, and FIG. 2E illustrates a view of the light 100 as if an observer were on a right side of the light 100. As shown in FIGS. 2A-2E, the light 100 may have a housing 110 which may house a light emitting device, for example, a light emitting diode, as well as a power supply, for example, a battery, to power the light emitting device. The housing 110 may also enclose circuitry necessary for transferring and/or controlling power to the light emitting device from the battery. In addition, the housing 110 may be water resistant in order to protect the internal contents of the housing 110 from water.

In at least one example embodiment, the light emitting device may be pivotally supported in the housing 110. For example, the light 100 may include a grip 120 operatively connected to the light emitting device such that if a user were to rotate the grip 120, the light emitting device in the housing 110 would rotate within the housing 110. As such, a direction of light may be controlled and may be directed in different directions depending on a preference of the user using the light 100.

In example embodiments the light 100 may have a back plate 130 and the back plate 130 may include at least one engaging member 137 configured to engage at least one engaging member 210 of the clip 200. In FIGS. 2A-2E, for example, the at least one engaging member 137 of the light 100 may be a pair of tabs 137 arranged at the sides of the back plate 130 and the at least one engaging member 210 of the clip 200 may be a pair of slotted members 210 arranged at the sides of the clip 200. In the particular embodiment of FIGS. 2A-3C, a spacing of the pair of tabs 137 may be similar to a spacing of the pair of slotted members 210 so that the pair of tabs 137 may be inserted into the pair of slotted members 210.

In example embodiments, the back plate 130 may have a back surface 132 which may be curved. In the embodiment of FIGS. 2A-3C, the clip 200 may have a similar curvature so that the back surface 132 of the back plate 130 may bear against a front surface of the clip 200.

Figure 3A:
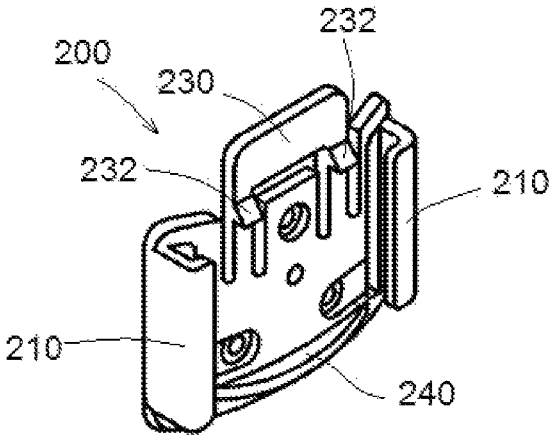
FIG. 3A is a perspective view of a clip in accordance with example embodiments.
Figure 3B:
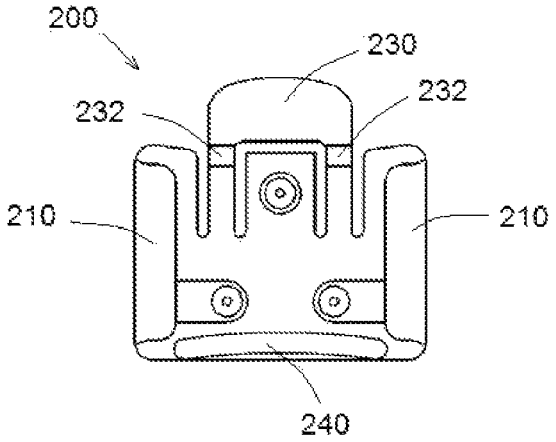
FIG. 3B is a front view of the clip in accordance with example embodiments.
Figure 3C:
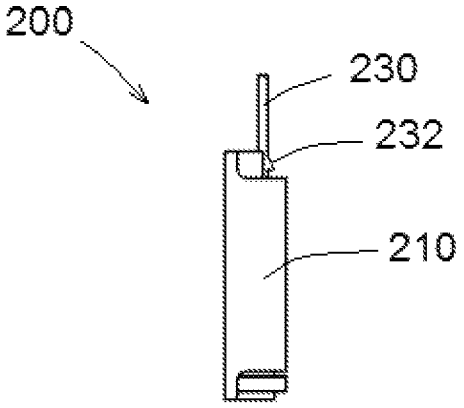
FIG. 3C is a side view of the clip in accordance with example embodiments.

FIGS. 3A-3C illustrate various views of the clip 200. In example embodiments, the clip 200 may have a tongue 230 and a stop 240. The tongue 230 may be a relatively flexible member which may flex as the light 100 is attached to the clip 200. The tongue 230 may include at least one capture member 232 which may be configured to engage a first surface 134 of the back plate 130. In example embodiments, the stop 240 may be spaced apart from the at least one capture member 232. In example embodiments, the stop 240 may be configured to engage a second surface 136 of the back plate 130. In example embodiments, a distance separating a top surface of the stop 240 and a bottom surface of the at least one capture member 232 may be about the same (or slightly larger than) a distance separating the first and second surfaces 134 and 136 of the back plate 130.

Figure 4A:
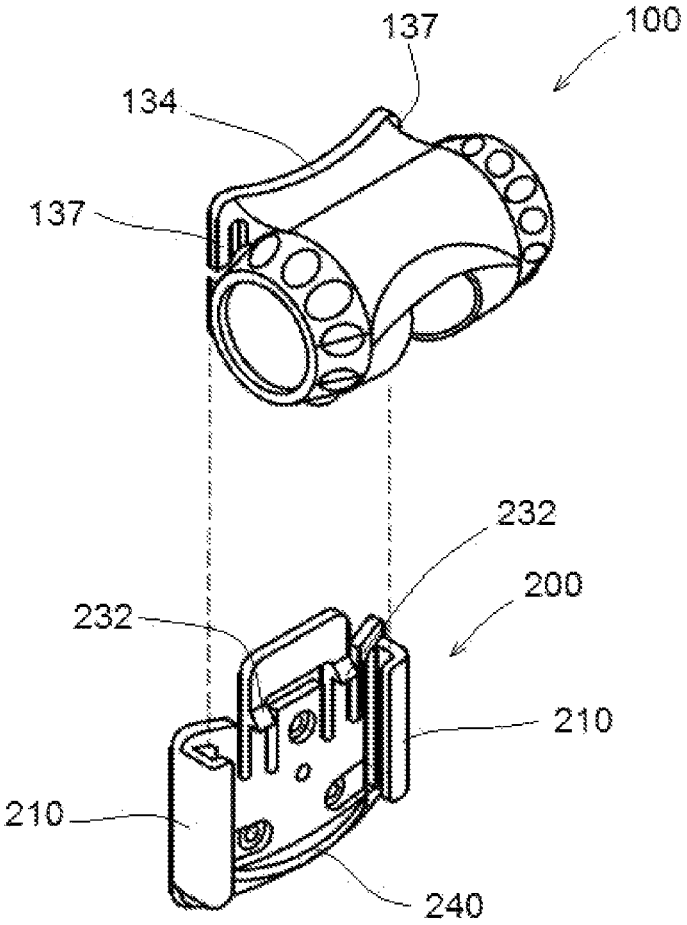
FIG. 4A is a view of the light separated from the clip in accordance with example embodiments.
Figure 4B:
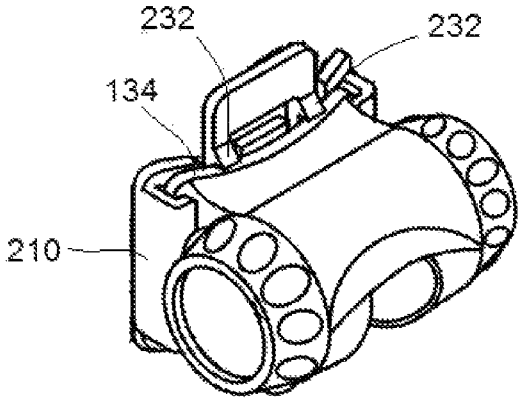
FIG. 4B is a view of the light attached to the clip in accordance with example embodiments.

FIGS. 4A-4B illustrate the light 100 connecting to the clip 200. As shown in FIGS. 4A-4B, the light 100 may be arranged near the clip 200 so that its tabs 137 are aligned with the slots of the slotted members 210. The light 100 may then be moved towards the clip 200 so that the tabs 137 are inserted into the slots of the slotted members 210. As the light 100 is being moved across the tongue 230 the tongue 230 elastically bends to allow the tabs 137 of the light 100 to advance into the slots of the slotted members 137, however, once the first surface 134 of the back plate 130 passes the bottoms of the capture members 232 the tongue 230 springs back to its original configuration such that the bottom surfaces of the capture members 232 reside over the first surface 134 of the back plate 130. The light 100 is prevented from moving further down the clip 200 by virtue of the stop 240 being configured to engage the second surface 136 of the of the back plate 130. Thus, the slotted members 210, the flexible tongue 230, and the stop 240 capture the light 100. In order to remove the light 100 from the clip 200 a user may press against the tongue 230 to move the capture members 232 away from the first surface 134 of the body 100. With the capture members 232 moved away from the first surface 134 of the back plate 130, the light 100 may be drawn out of the clip 200.

Figure 5A:
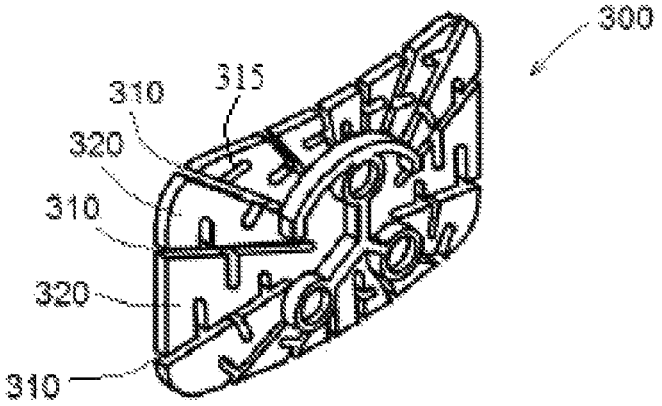
FIG. 5A is a perspective view of a bracket in accordance with example embodiments.
Figure 5B:
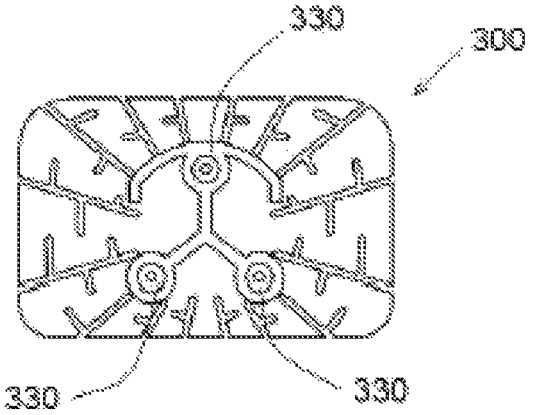
FIG. 5B is a front view of the bracket in accordance with example embodiments.
Figure 5C:
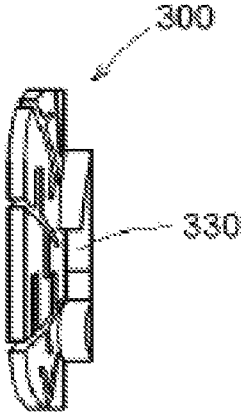
FIG. 5C is a side view of the bracket in accordance with example embodiments.

FIGS. 5A-5C are views of the bracket 300 in accordance with example embodiments. As shown in FIGS. 5A-5C the bracket 300 may resemble a rectangular plate. The shape, however, may be varied from one embodiment to another. For example, in another embodiment, the shape of the bracket 300 may be disk shaped. As shown in FIGS. 5A-5C the bracket 300 may be formed with a plurality of slits 310 (three of which are labeled) to form a plurality of flanges 320 (only two of which are labeled). The slits 310 forming the flanges 320 may form a relatively flexible bracket which may deform to fit on a non-flat or irregular surface. Such a configuration is highly desired for application as a bracket 300 to serve as an intermediary member for attaching a device, for example, a light, to a helmet as the curvature of a helmet may vary in different directions. In order to increase the flexibility of the bracket 300 additional slits 315 in the flanges 320 may be formed. In addition to the flanges 320, the bracket 300 may also include spacers 330. Some of the spacers 330, as shown in FIGS. 5A-5C may be include apertures that may assist in connecting the bracket 300 to the clip 200. However, the spacers 330 may also include an additional spacer which may resemble an arc shaped spacer. Also, in at least one embodiment, the bracket 300 may be formed to have a curve to facilitate connecting the bracket 300 to a curved structure such as, but not limited to, a helmet. A such, the bracket 300 may resemble a curved plate.

Figure 6A:
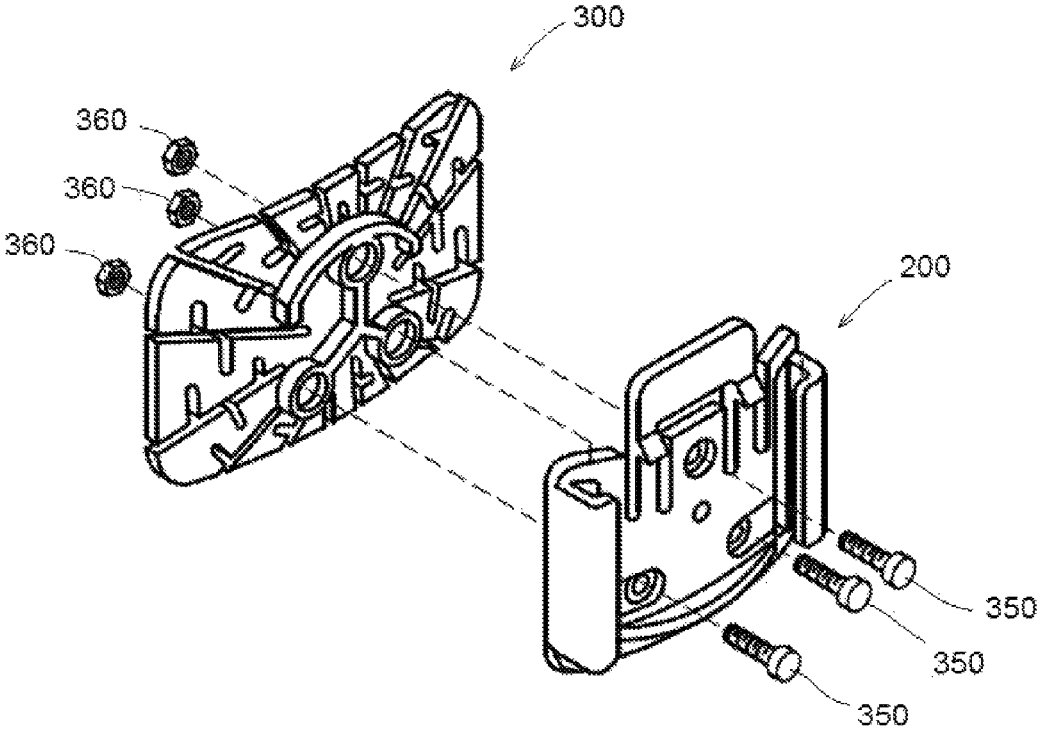
FIG. 6A is an exploded perspective view of the clip and bracket in accordance with example embodiments.
Figure 6B:
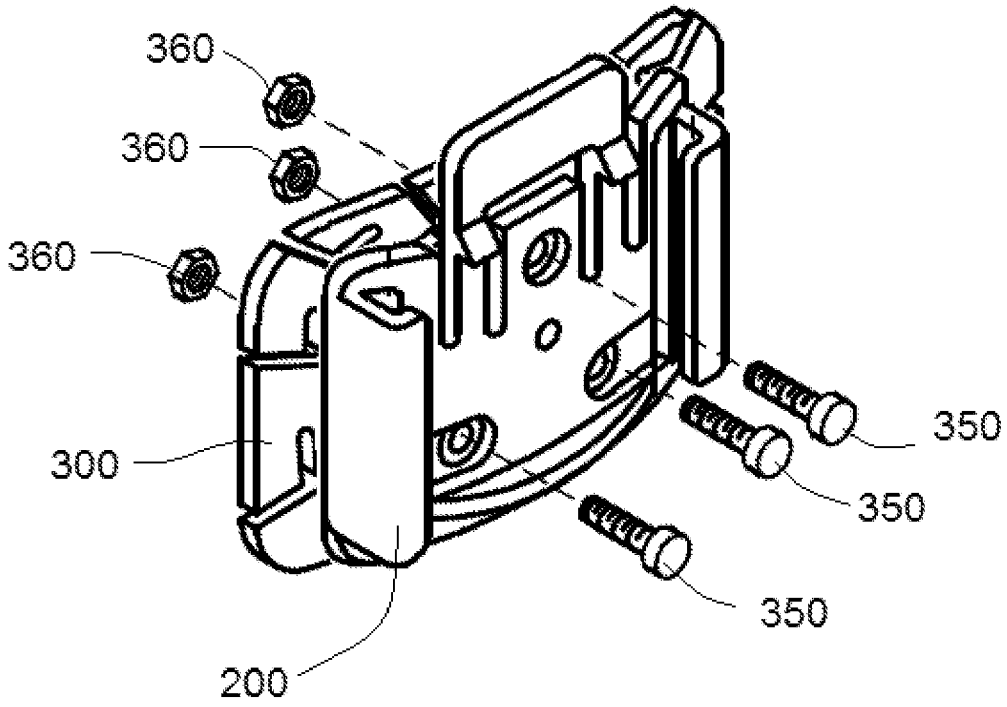
FIG. 6B is a view of the clip and bracket arranged near each other in accordance with example embodiments.
Figure 6C:
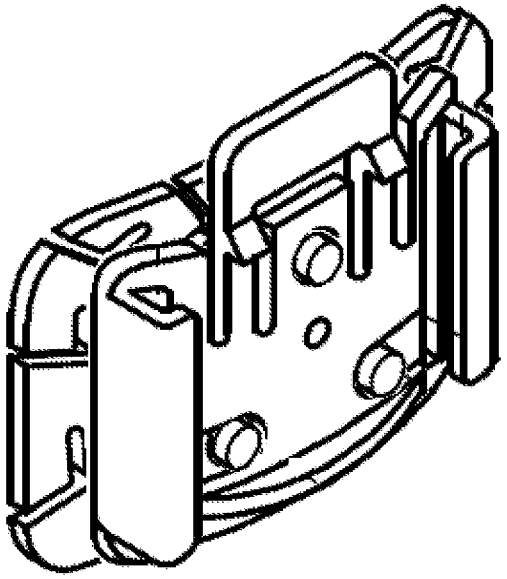
FIG. 6C is a view of the clip attached to the bracket in accordance with example embodiments.

FIGS. 6A-6C illustrate operations associated with connecting the clip 200 to the bracket 300. As shown in FIGS. 6A-6C the clip 200 may include a plurality of apertures which have a substantially same spacing as a plurality of apertures of the bracket 300. As shown in FIGS. 6A-6C the clip 200 may be arranged so that its plurality of apertures are substantially in line with the plurality of aperatures of the bracket 300 and threaded fasteners (for example, screws 350 and nuts 360) may be used to connect the clip 200 to the bracket 300. Although the particular example of FIGS. 6A-6C show that each of the clip 200 and the bracket 300 may have three apertures for connecting the clip 200 to the bracket 300, this is for purposes of illustration only as there may be more or less than three apertures usable for connecting the clip 200 to the bracket 300. Furthermore, although threaded fasteners are shown as connecting the clip 200 to the bracket 300, the clip 200 and bracket 300 may be connected by an alternative means such as, but not limited to, an adhesive or a weld.

Figure 7A:
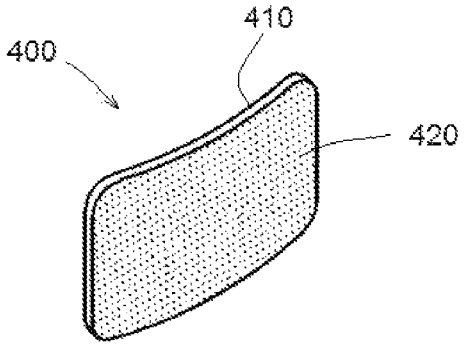
FIG. 7A is a perspective view of an adhesive member in accordance with example embodiments.
Figure 7B:
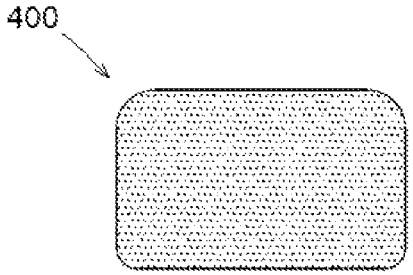
FIG. 7B is a front view of the adhesive member in accordance with example embodiments.
Figure 7C:
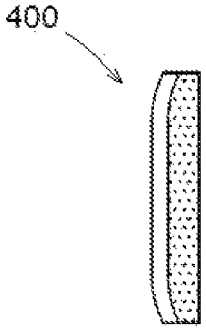
FIG. 7C is a side view of the adhesive member in accordance with example embodiments.

FIGS. 7A-7C illustrate the adhesive member 400 member in greater detail. As shown in FIGS. 7A-7C the adhesive member 400 may be a double sided adhesive tape. For example, a first side 410 and a second side 420 of the adhesive member 400 may have an adhesive applied thereto. As such, when the adhesive member 400 is sandwiched between the bracket 300 and the helmet 10 the adhesive member 400 may attach the bracket 300 to the helmet 10.

In view of the preceding discussion it is clear the assembly 1000 of example embodiments provides an easy method of attaching a light to a helmet 10. For example, in example embodiments, the bracket 300 may be attached to the clip 200 as described above and illustrated in FIGS. 6A-6C. This structure may be attached to the helmet 10 by the adhesive member 400 and the light 100 may be attached to the helmet 10 by executing the operations illustrated in FIGS. 4A-4B.

It is understood there are variations of the above elements which are considered to be within the scope of the invention. For example, in the aforementioned examples the engaging members 137 of the light 100 are illustrated as being tabs and the engaging members 210 of the clip 200 are illustrated as being slotted members having slots configured to receive the tabs. However, in example embodiments the engaging members 137 may alternatively be slotted members and the engaging members 210 may alternatively be tabs configured to insert into the slots of the engaging members 137. In addition, rather than having separate clip 200 and bracket 300 connected to each other via a connecting means (for example screws 350 and nuts 360 or an adhesive) the clip 200 and bracket 300 may be formed as a unitary structure through a casting process.

Figure 8A:
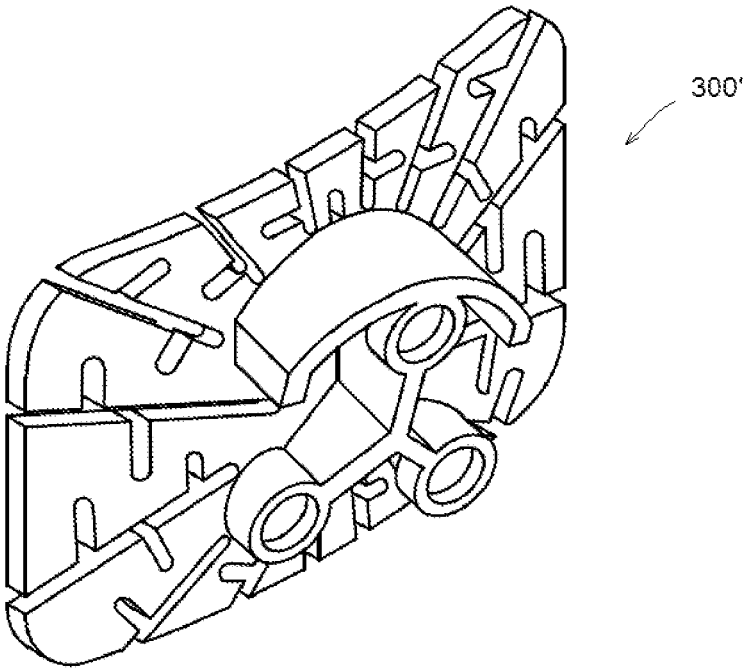
FIG. 8A is a perspective view of an alternate bracket in accordance with example embodiments.
Figure 8B:
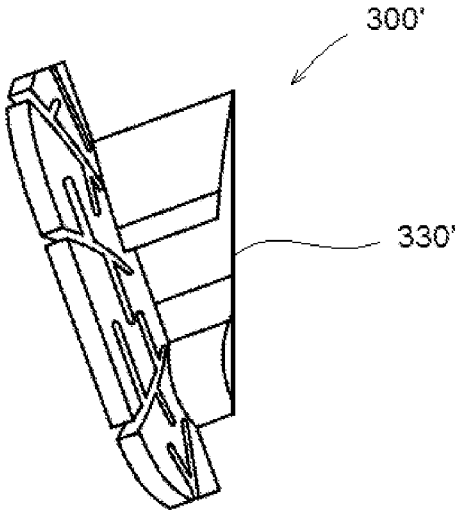
FIG. 8B is a side view of the alternate bracket in accordance with example embodiments.

The invention is also construed to cover other modifications. For example, FIGS. 8A and 8B illustrate an alternative bracket 300'. The alternative bracket 300' is substantially identical to the bracket 300 except that the spacer 330' of the alternative bracket 300' has an inclined surface. In this latter embodiment, when the clip 200 is attached to the bracket 300' the clip 200 may be angled "downward" with respect to the bracket 300'. Thus, when the bracket 330's is attached to a helmet 10 with the clip 200 attached thereto and the light 100 is inserted into the clip 200 the light may point in a downward direction.

Figure 9A:
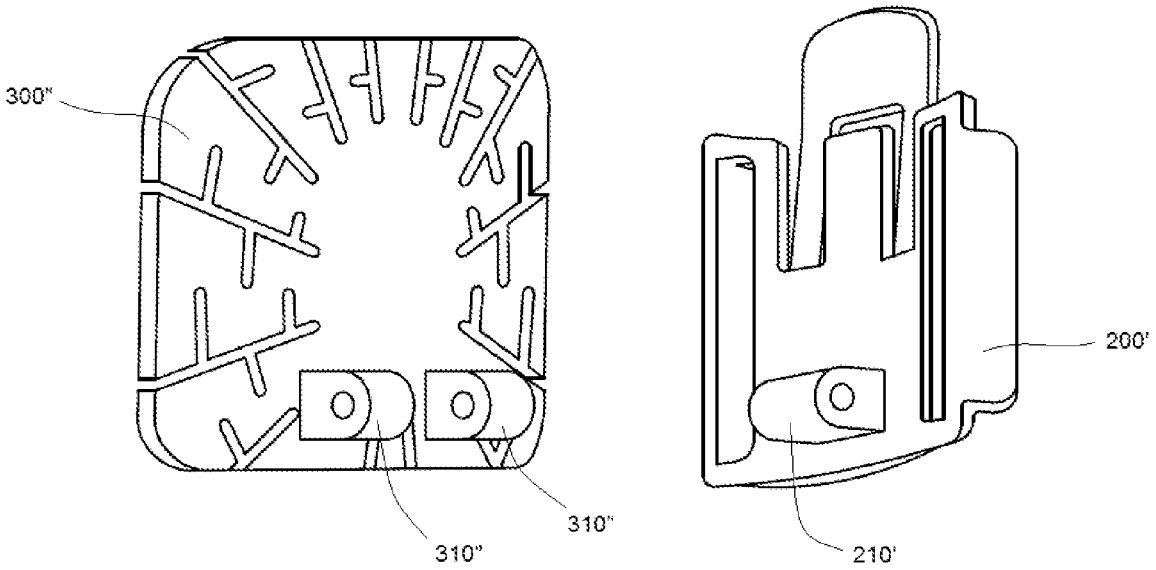
FIG. 9A are views of an alternative bracket and clip in accordance with example embodiments.
Figure 9B:
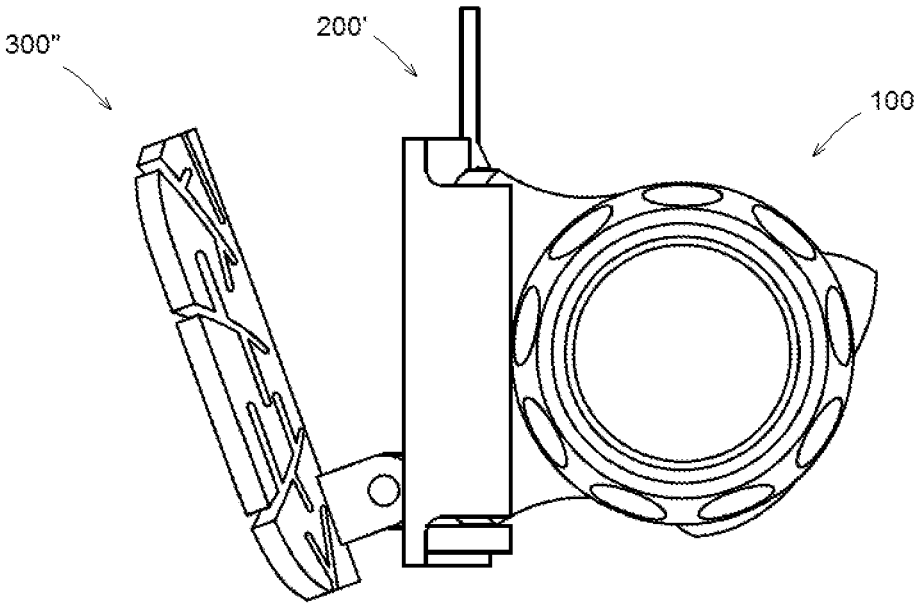
FIG. 9B is a view of the alternative bracket and clip pin connected to one another in accordance with example embodiments.

Another modification is illustrated in FIGS. 9A-9B. FIG. 9A, for example, illustrates another alternative bracket 300" and an alternative clip 200'. In the embodiment of FIGS. 9A and 9B the bracket 300" may be substantially identical to bracket 300 except that bracket 300" may not include the spacer 300 but instead include a connecting structures 310" which allows the bracket 300" to pin connect to the clip 200' via a similar connecting structure 210' arranged on a back of the clip 200'. FIG. 9B illustrates the assembly with a light 100, clip 200', and bracket 300". In the embodiment of FIGS. 9A-9B the bracket 300" may be attached to a helmet via adhesive member 400 and the clip 200' and light 100 may be rotated with respect to the helmet by virtue of the pin type connection between the bracket 300" and the clip 200'.

Figure 10A:
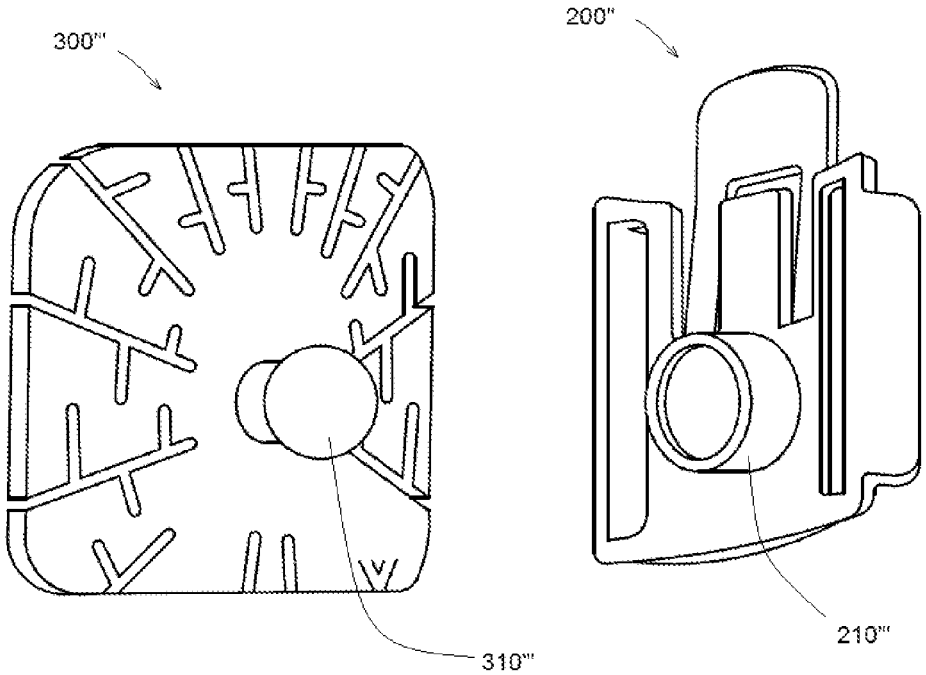
FIG. 10A are views of an alternative bracket and clip in accordance with example embodiments.
Figure 10B:
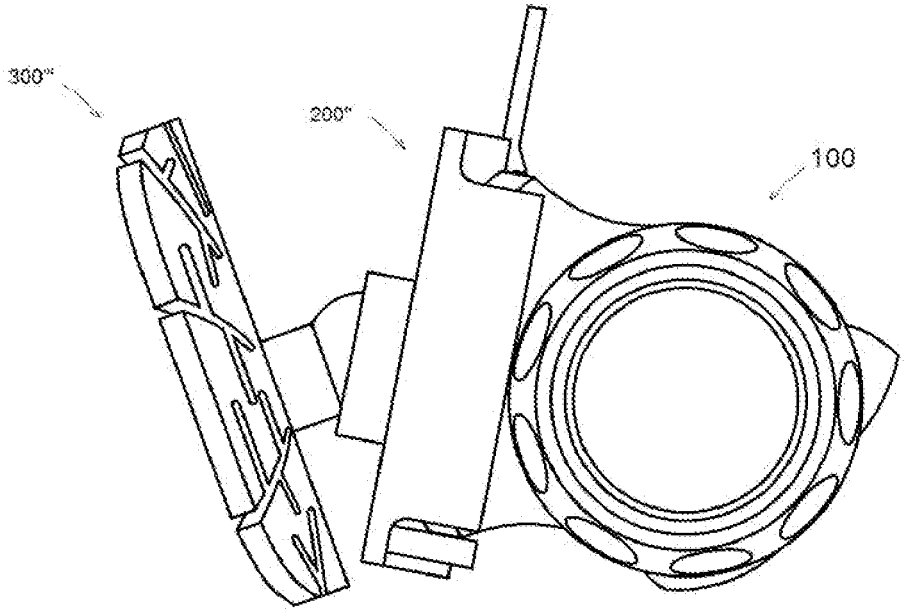
FIG. 10B is a view of the alternative bracket and clip connected to one another in accordance with example embodiments.

Another modification is illustrated in FIGS. 10A-10B. FIG. 10A, for example, illustrates another alternative bracket 300'" and an alternative clip 200". In the embodiment of FIGS. 10A and 10B the bracket 300'" may be substantially identical to bracket 300 except that bracket 300'" may not include the spacer 300 but instead may include a ball 310'" which allows the bracket 300'" to connect to the clip 200" via a socket 210" arranged on a back of the clip 200". FIG. 10B illustrates the assembly with a light 100, clip 200", and bracket 300'". In the embodiment of FIGS. 10A-10B the bracket 300'" may be attached to a helmet via adhesive member 400 and the clip 200" and light 100 may be rotated with respect to the helmet by virtue of the ball/socket type connection between the bracket 300'" and the clip 200". Example embodiments are not intended to be strictly limited by the aforementioned description. For example, in another embodiment the ball may be attached to the back of the clip 200" and the socket may be attached to the front of the bracket 300".

It is understood the disclosed assemblies may be modified. For example, although the above assemblies illustrate a light 100 being attached to a helmet 10 via the aforementioned brackets and clips, the invention is not limited thereto. For example, another type of electrical device, for example, a camera, may have a housing configured with tabs similar to the housing 110 of the light 100. Thus, any of the previously disclosed systems may be used to attach another type of electrical device, for example, a camera, to a helmet.

The foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that which falls within the scope of the claims.

What is claimed is:

1. An assembly comprising:

an electrical device;

a clip; and a bracket, wherein the electrical device includes at least one engaging member configured to engage at least one engaging member on the clip, and the clip is configured to attach to the bracket with at least one fastener, wherein the bracket includes a plurality of slots forming a plurality of flanges and the plurality of flanges includes a plurality of slots to impart flexibility to the bracket.

2. The assembly of claim 1, wherein the at least one engaging member of the electrical device is one of a tab and a slotted member and the at least one engaging member of the clip is the other of the tab and the slotted member.

3. The assembly of claim 2, wherein the tab is configured to insert into a slot of the slotted member.

4. The assembly of claim 2, wherein the at least one engaging member of the electrical device is a pair of tabs and the at least one engaging member of the clip is a pair of slotted members configured to receive the pair of tabs.

5. The assembly of claim 1, wherein the clip further includes a flexible tongue with a capture member configured to engage a first surface of the electrical device.

6. The assembly of claim 5, wherein the clip includes a stop configured to engage a second surface of the electrical device.

7. The assembly of claim 6, wherein the stop, capture member, and pair of slotted members are configured to capture the electrical device.

8. The assembly of claim 5, wherein the electrical device has a body with a curved back plate between the pair of tabs and the clip has a curved body having a substantially same curvature as the curvature of the back plate of the electrical device.

9. The assembly of claim 1, wherein the clip has at least one aperture through which the at least one fastener may be inserted to attach to the clip to the bracket.

10. The assembly of claim 9, wherein the at least one fastener is a threaded member.

11. The assembly of claim 1, wherein the electrical device includes a housing having a first curvature, the clip includes a body having a second curvature, and the bracket includes a body having a third curvature, wherein the first, second, and third curvatures are substantially the same.

12. An assembly comprising:

a light having a curved back plate with a first tab at a first side of the curved plate and a second tab at a second side of the curved plate;

a clip having a first slotted member receiving the first tab and a second slotted member receiving the second tab, the clip further including a stop engaging a bottom surface of the curved plate and a flexible tongue between the first and second slotted members, the flexible tongue having at least one capture member engaging a top surface of the curved back plate to retain the curved back plate in the clip, a distance between a top surface of the stop and a bottom surface of the at least one capture member being about the same as a distance from the bottom surface of the curved back plate and the top surface of the curved back plate; and a bracket comprised of a plurality of flanges each having a plurality of slots to impart flexibility to the bracket.

* * * * *